US006294863B1

(12) United States Patent
Shimizu et al.

(10) Patent No.: US 6,294,863 B1
(45) Date of Patent: Sep. 25, 2001

(54) COLOR CATHODE RAY TUBE HAVING A SHADOW MASK WITH A PLURALITY OF STRIP SHAPED REINFORCING BEADS

(75) Inventors: Norio Shimizu; Shinichiro Nakagawa, both of Fukaya; Masatsugu Inoue, Kumagaya, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/210,795

(22) Filed: Dec. 15, 1998

(30) Foreign Application Priority Data

Dec. 18, 1997 (JP) ..... 9-349184

(51) Int. Cl.[7] ..... H01J 29/80

(52) U.S. Cl. ..... 313/402; 313/404; 313/403; 313/407

(58) Field of Search ..... 313/402–408, 313/476

(56) References Cited

U.S. PATENT DOCUMENTS

| | | | | |
|---|---|---|---|---|
| 3,872,345 | * | 3/1975 | Yamakazi et al. | 313/402 |
| 3,923,566 | * | 12/1975 | Law | 313/402 |
| 3,944,867 | * | 3/1976 | Kaplan | 313/402 |
| 4,146,816 | * | 3/1979 | Morrell | 313/402 |
| 4,173,729 | * | 11/1979 | Stone et al. | 313/403 |
| 4,293,791 | * | 10/1981 | D'Amato | 313/403 |
| 5,384,511 | * | 1/1995 | Fujimura | 313/402 |
| 5,506,466 | | 4/1996 | Shoda et al. | 313/402 |
| 5,523,647 | * | 6/1996 | Kawamura et al. | 313/407 |

* cited by examiner

*Primary Examiner*—Nimeshkumar D. Patel
*Assistant Examiner*—Mariceli Santiago
(74) *Attorney, Agent, or Firm*—Oblon, Spivak, McClelland, Maier & Neustadt, P.C.

(57) ABSTRACT

A color cathode ray tube is provided with a shadow mask having a mask body including a substantially rectangular effective surface in which a large number of electron beam passage apertures are formed.

A plurality of reinforcing beads are formed on the effective surface, and project therefrom to have heights which varies in accordance with positions such that in at least a part of an area for provision of the reinforcing beads, the heights of the reinforcing beads satisfy the following relationship:

$$dx1>dx2,\ dy1>dy2$$

where dx1 is the height measured at a first position which is apart from a longer axis of the effective surface and a distance x1 apart from a shorter axis thereof, dx2 is the height measured at a second position which is further apart from the longer axis than the first position and a distance x2 apart from the shorter axis, dy1 is the height measured at a third position which is located on the shorter axis and a distance y1 apart from the longer axis, dy2 is the height measured at a fourth position which is a distance apart from the shorter axis and a distance y2 apart from the longer axis, and the distances x1, x2, y1 and y2 satisfy the following relationship: x1=x2=y1=y2.

14 Claims, 4 Drawing Sheets

COLOR CATHODE RAY TUBE HAVING A SHADOW MASK WITH A PLURALITY OF STRIP SHAPED REINFORCING BEADS

BACKGROUND OF THE INVENTION

The present invention relates to a color cathode ray tube, and in particular, a color cathode ray tube having reinforcing beads which increase a curved surface-holding strength of a shadow mask.

In general, a color cathode ray tube is provided with an envelope which comprises a funnel and a substantially rectangular panel including an effective portion having a curved surface and a skirt portion provided at a peripheral portion of the effective portion. A phosphor screen is formed on the inner surface of the effective portion of the panel, and comprises three-color phosphor layers which emit three light components of blue, green, and red. A substantially rectangular shadow mask is located inward of and opposite to the phosphor screen. Furthermore, an electron gun for emitting three electron beams is arranged within a neck of the funnel.

In the color cathode ray tube, three electron beams emitted from the electron gun are deflected by means of a deflecting unit mounted on the outer side of the funnel, and horizontally and vertically scans over the phosphor screen through the shadow mask, thereby displaying a color image.

The shadow mask is intended to select the three electron beams emitted from the electron gun so that they are correctly incident on the three-color phosphor layers. The shadow mask comprises a substantially rectangular mask body and a substantially rectangular mask frame attached to a skirt portion of the mask body. The mask body has an effective surface and the skirt portion provided at a peripheral area of the effective surface. In the effective surface, a large number of electron beam passage apertures are arranged in a predetermined manner, and allow electron beams to pass therethrough. The effective surface is constituted by a curved surface opposite to the phosphor screen.

In the color cathode ray tube having the above structure, the electron beams passing through the electron beam passage apertures of the shadow mask must be correctly landed on the three-color phosphor layers, in order to display an image with no color deviation on the phosphor screen. Thus, it is necessary to maintain the correct positional relationship between the panel and the shadow mask.

In recent years, in color cathode ray tubes, the effective portion of the panel has been flattened, and as a result, the effective surface of the shadow mask has also been flattened, reducing the curvature of the effective surface. In such a manner, when the curvature decreases, the strength of the shadow mask lowers, as a result of which there is a possibility of the shadow mask being deformed in the manufacturing process of the color cathode ray tube. When the shadow mask is deformed, the positional relationship between the shadow mask and the panel varies, and the color purity of a displayed image greatly deteriorated.

Furthermore, when the color cathode ray tube operates, parts of the electron beams emitted from the electron gun impinge on the shadow mask, and are then converted into heat energy, heating the shadow mask. As a result, a doming of the shadow mask is generated. To be more specific, it thermally expands toward the phosphor screen. Due to doming, when the distance between the effective surface of the shadow mask and the inner surface of the panel varies, and exceeds an allowed range, electron beams mis-land on the phosphor layers, thus lowering the color purity. In particular, when an image pattern having a high luminance is locally displayed, doming of the shadow mask locally occurs, and local mis-landing is brought about in a short time period. In addition, as a result of flattening the shadow mask as mentioned above, doming further easily occurs as the curvature of the effective surface of the shadow mask decreases.

U.S. Pat. No. 5,506,466 discloses a shadow mask wherein steps (reinforcing beads) are provided at an effective surface, as means for preventing lowering of image quality which is caused by deformation of the shadow mask and local doming thereof. In other words, the reinforcing beads are intended to improve the curved surface-holding strength of the shadow mask, and as mentioned above, prevent local doming and deformation of the shadow mask in the manufacturing process.

However, if the reinforcing beads are applied to a shadow mask provided with an effective surface having a small curvature, and its position and height are set in such a way to achieve a sufficient effect, the distance between the effective surface of the shadow mask and the inner surface of the effective portion of the panel changes locally. Therefore, when a phosphor screen is formed by a photographic printing method using the above shadow mask as a photomask, the reinforcing beads influence to the photographic printing of the phosphor screen, and as a result, the appearance quality of the phosphor screen remarkably lowers. Considering lowering of the appearance quality, the height of the step or the reinforcing bead is limited to about 0.1 to 0.20 m. However, if the height is limited to such a degree, it is difficult to sufficiently increase the curved surface-holding strength of the shadow mask having an effective surface having a small curvature.

BRIEF SUMMARY OF THE INVENTION

The present invention has been made in consideration of the above circumstances, and its object is to provide a color cathode ray tube wherein the curved surface-holding strength of an effective surface of a shadow is sufficiently high, and thus deformation and doming of the shadow mask can be reduced, and the image quality is improved.

In order to attain the above object, a color cathode ray tube according to the present invention comprises:

- an envelope including a panel and a funnel joined to the panel, the panel having a substantially rectangular effective portion and a phosphor screen formed on an inner surface of the effective portion;
- a shadow mask arranged to oppose the phosphor screen; and
- an electron gun provided within a neck of the funnel, for emitting electron beams onto the phosphor screen through the shadow mask.

The shadow mask comprises a substantially rectangular effective surface having a large number of electron beam passage apertures formed therein, for allowing the electron beams to pass therethrough, the effective surface having a center located on a tube axis, and a longer axis and a shorter axis extending perpendicular to each other through the center; and a plurality of reinforcing beads formed on the effective surface to reinforce the effective surface. The reinforcing beads project from the effective surface to have heights which vary in accordance with positions such that the heights of the reinforcing beads decrease successively or in stages by a predetermined distance away from the longer axis, and the heights of the reinforcing beads decrease successively or in stages by a predetermined distance away from the shorter axis.

Furthermore, according to the color cathode ray tube, the reinforcing beads project from the effective surface such that in at least a part of that area of the effective surface on which the reinforcing beads are provided, the heights of the reinforcing beads satisfy the following relationship:

$$dx1>dx2,\ dy1>dy2$$

where dx1 denotes the height measured at a first position which is apart from the longer axis, and which is a distance x1 apart from the shorter axis, dx2 denotes the height measured at a second position which is further apart from the longer axis than the first position, and which is a distance x2 apart from the shorter axis, dy1 denotes the height measured at a third position which is located on the shorter axis, and which is a distance y1 apart from the longer axis, dy2 denotes the height measured at a fourth position which is apart from the shorter axis, and which is a distance y2 apart from the longer axis, and the distances x1, x2, y1 and y2 satisfy the following relationship:

$$x1=x2=y1=y2.$$

By virtue of the above structural features, the reinforcing beads provided on the effective surface of the shadow mask increase the curved surface-holding strength of the effective surface. As a result, in the resultant color cathode ray tube, deformation of the shadow mask in the manufacturing process of the color cathode ray tube and doming of the shadow mask at the operating time of the color cathode ray tube can be reduced, and the image quality is hardly lowered. Furthermore, the phosphor screen can be formed to have a high quality appearance. This is because the reinforcing beads whose heights satisfy the above relationships have no influence on formation of the phosphor screen.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A color cathode ray tube according to an embodiment of the present invention will be explained in detail with reference to the accompanying drawings.

Figure 1:
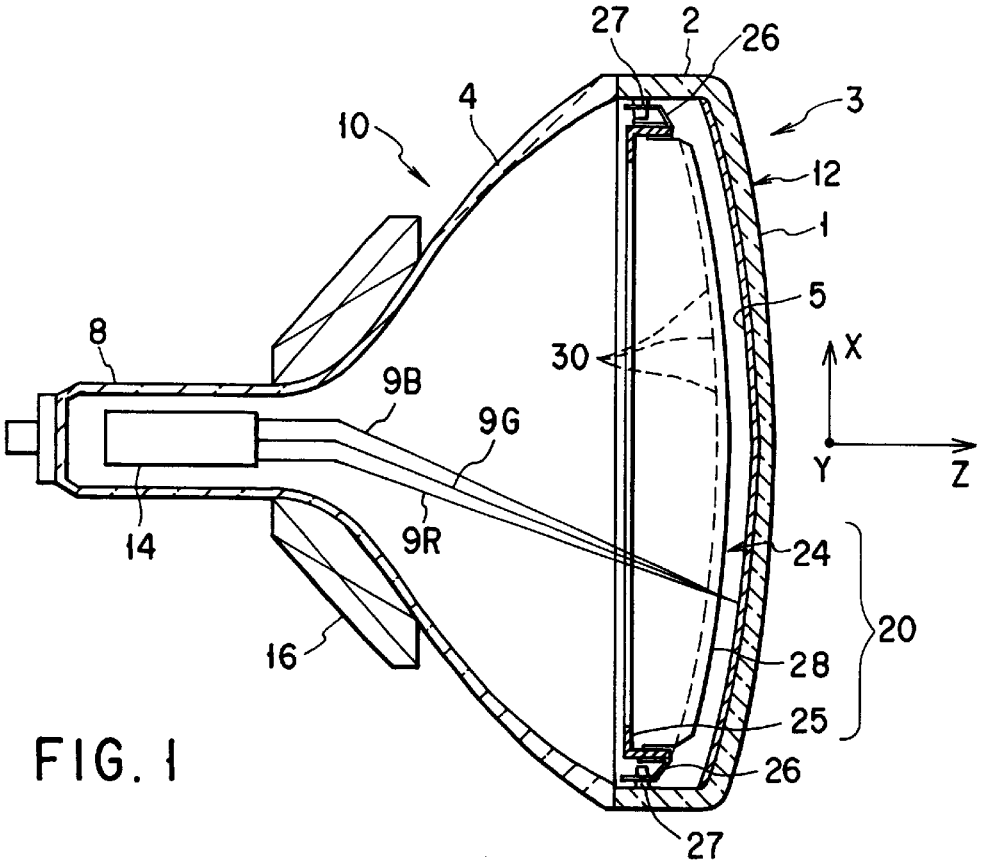
FIG. 1 is a cross-sectional view of a color cathode ray tube according to an embodiment of the present invention.

As shown in FIG. 1, the color cathode ray tube has an envelope 10 formed of glass. The envelope 10 comprises a panel 3 and a funnel 4. The panel 3 includes a substantially rectangular face plate 1 and a skirt portion 2 provided at a peripheral portion of the face plate 1. The funnel 4 is joined to the skirt portion 2.

The face plate 1 has a substantially rectangular effective portion 12 formed of a curved surface and having a horizontal axis X and a vertical axis Y which are perpendicular to each other and also perpendicular to a tube axis Z.

A phosphor screen 5 is formed on an inner surface of the effective portion 12, and includes stripe shaped three-color phosphor layers which extend in parallel to the vertical axis Y and emit blue, green and red light components. In the envelope 10, a substantially rectangular shadow mask 20 is arranged opposite to the phosphor screen 5. In a neck 8 of the funnel: 4, an inline type electron gun 14 for emitting three electron beams 9B, 9G and 9R is provided.

In the color cathode ray tube, the three electron beams 9B, 9G and 9R emitted from the electron gun 14 are deflected by a magnetic field generated from a deflecting unit 16 mounted on an outer side of the funnel 4, and horizontally and vertically scan over the phosphor screen 5 through the shadow mask 20, thereby displaying a color image.

Figure 2A:
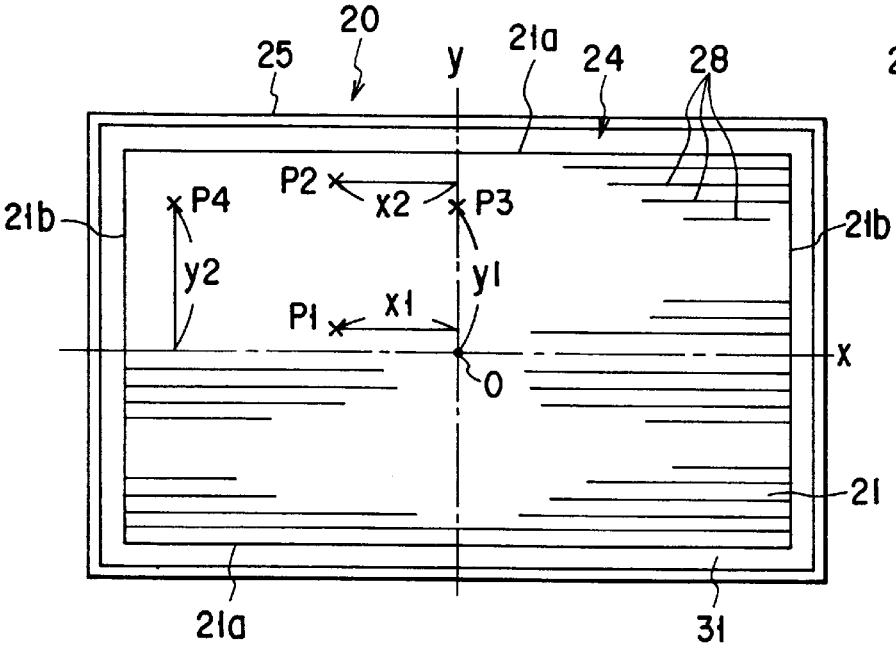
FIG. 2A is a front view of a shadow mask of the color cathode ray tube.
Figure 2B:
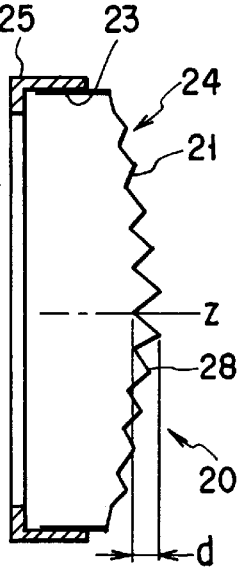
FIG. 2B is a cross-sectional view of the shadow mask.

As shown in FIGS. 1, 2A and 2B, the shadow mask 20 comprises a substantially rectangular mask body 24 and a substantially rectangular mask frame 25 attached to a skirt portion 23 of the mask body 24. The mask body 24 has a substantially rectangular effective surface 21 and a non-aperture portion 31 and the skirt portion 23, all formed integral with each other. The effective surface 21 is constituted by a curved surface which is shaped in accordance with the shape of the phosphor screen 5, and has a large number of electron beam passage apertures 30 arranged in a predetermined manner. The non-aperture portion 31 is arranged to surround the effective surface 21. The skirt portion 23 is formed in the shape of a rectangular frame, and is provided at a peripheral portion of the non-aperture portion 31.

Elastic supporting members 26 are fixed to the mask frame 25, and are respectively engaged with supporting pins 27 provided at the skirt portion 2 of the panel 3, whereby the shadow mask 20 is supported inward of the panel 3.

The effective surface 21 of the mask body 24 has a center O located on the tube axis Z, and a longer axis x and a shorter axis y which extend perpendicular to each other through the center O, and respectively correspond to the horizontal axis X and the vertical axis Y of the panel 3.

Furthermore, the effective surface 21 has a pair of long sides 21*a* parallel to the longer axis x and a pair of short sides 21*b* parallel to the shorter axis y.

As is clear from FIG. 2, a plurality of steps, i.e., strip-shaped reinforcing beads 28 are formed on the entire area of the effective surface 21 of the mask body 24. They are formed to constitute a corrugated surface, and extend between the short sides 21*b* in parallel with the longer axis X. In addition, the beads 28 project toward the phosphor screen 5 to have heights d.

The heights d of the reinforcing beads 28 vary in accordance with their positions. To be more specific, the heights d of the reinforcing beads 28 decrease successively or in stages by a predetermined distance away from the longer axis X, and the heights of the reinforcing beads 28 also decrease successively or in stages by a predetermined distance away from the shorter axis y.

For example, in at least a part of that area of the effective surface 21 on which the reinforcing beads 28 are provided, they are formed to satisfy the following relationship (1):

$$dx1>dx2,\ dy1>dy2 \quad (1)$$

where, as shown in FIG. 2A, dx1 denotes the height of the reinforcing bead 28 at a position P1 which is slightly apart from the longer axis x, and which is a distance x1 apart from the shorter axis y, dx2 denotes the height of the reinforcing bead 28 at a position P2 which is further apart from the longer axis x than the position P1, and which is a distance x2 apart from the shorter axis y, dy1 denotes the height of the reinforcing bead 28 at a position P3 which is located on the shorter axis y, and which is a distance y1 apart from the longer axis x, and dy2 denotes the height of the reinforcing bead 28 at a position P4 which is apart from the shorter axis y, and which is a distance y2 apart from the longer axis x.

In this case, the above distances x1, x2, y1 and y2 satisfy the following relationship (2):

$$x1=x2=y1=y2 \quad (2)$$

Furthermore, according to the above embodiment, the reinforcing beads 28 are formed to satisfy the following relationship: $dy1 \geqq dx1$.

Figure 3:
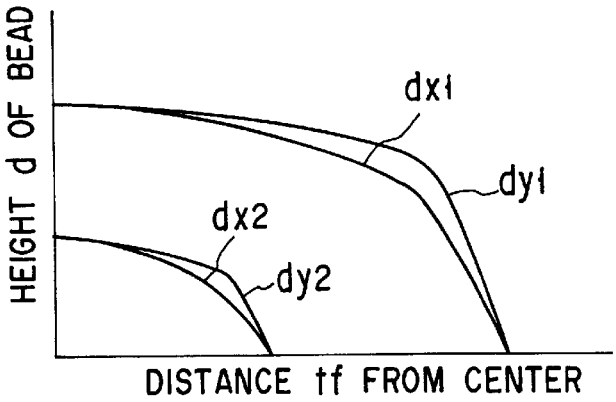
FIG. 3 is a graph showing a relationship between the positions and heights of reinforcing beads provided at the shadow mask.

FIG. 3 is a graph showing an example of the relationship between the heights dx1, dx2, dy1 and dy2 of the reinforcing beads 28. In this graph, the axis of abscissa indicates the distance rf between the reinforcing bead 28 and the center O of the effective surface 21, and the axis of ordinate indicates the height of the reinforcing bead.

In the color cathode ray tube having the above structure, when the phosphor screen 5 is formed, the shadow mask 20 is used as a photomask, and the phosphor layers are exposed and developed by a photographic printing method. As in the embodiment, when the reinforcing beads 28 are provided on the effective surface 21 of the shadow mask 20, the phosphor screen 5 can be formed by the photographic printing method without being degraded in appearance quality. At the same time, the reinforcing beads 28 improve the curved surface-holding strength of the mask body, and restricts deformation of the shadow mask in the manufacturing process of the color cathode ray tube and doming at the operating time of the cathode ray tube. As a result, in the resultant cathode ray tube, the image quality is not likely to degrade.

Figure 4:
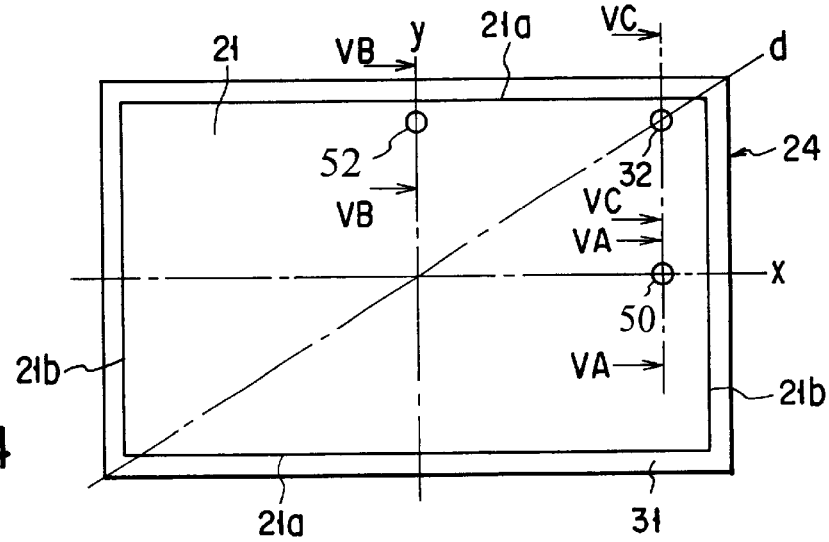
FIG. 4 is a front view for showing points on a longer axis, a shorter axis and a diagonal axis of at the shadow mask.
Figure 5A:
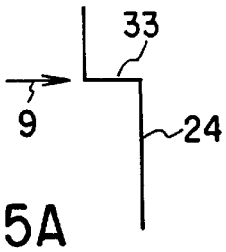
FIGS. 5A to 5C are cross-sectional views for respectively showing incident directions of electron beams at the points shown in FIG. 4.
Figure 5B:
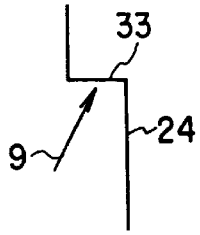
Figure 5C:
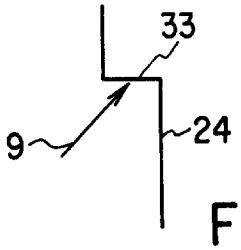

Specifically, in the case where the plurality of strip-shaped reinforcing beads 28 are provided on the entire effective surface 21 of the mask body 24 to extend in parallel to the longer axis x of the mask body 24, electron beams 9 (9B, 9G and 9R) are incident on the shadow mask in respective incident directions, as illustrated in FIGS. 5A to 5C which respectively show cross sections taken along lines parallel to the shorter axis y, at positions 50, 52 and 32 respectively located on the longer axis x, shorter axis y and diagonal axis d as shown in FIG. 4. To be more specific, in the vicinity of the position 50 on the longer axis x, the incident direction of the electron beam 9, as shown in FIG. 5A, is substantially the same as the height direction of a step 33 which is formed when the reinforcing bead 28 is bent to be corrugated. Therefore, the amount of the electron beam 9 incident onto the step 33 is small.

On the other hand, in the vicinity of the position 31 on the shorter axis y and that of the position 32 on the diagonal axis d, the incident direction of the electron beam 9 is inclined to the height direction of the step 33 as shown in FIGS. 5B and 5C, and thus the amount of the electron beam 9 incident on the step 33 is large.

Figure 6A:
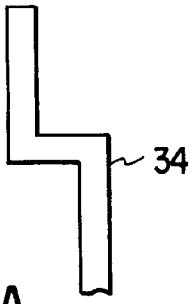
FIGS. 6A to 6C are views schematically showing phosphor layers formed in positions corresponding to the points shown in FIG. 4, respectively.
Figure 6B:
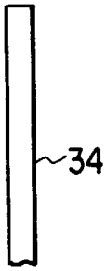
Figure 6C:
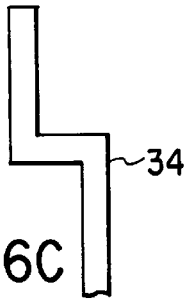

Therefore, if large steps 33 are defined by forming the reinforcing beads 28, the shapes of phosphor layers 34, which are formed by the photographic printing method using the shadow mask 20 as a photomask, vary in accordance with their positions. To be more specific, in the vicinity of the position 50 on the longer axis x, the phosphor layers 34 are not straight and are formed in a stepped manner as shown in FIG. 6A, due to the influence of the varying height of the effective surface 21 which is caused by the steps 33. On the other hand, in the vicinity of the position 31 on the shorter axis y, formation of the phosphor layers 34 is hardly influenced by the steps 33 because of the relation between the incident direction of the electron beams and the extending direction of the strip-shaped phosphor layers, and they are thus correctly strip-shaped as shown in FIG. 6B. As shown in FIG. 6C, in the vicinity of the position 32 on the diagonal axis d, formation of the phosphor layers 34 are effected by the varying height of the effective surface 21 which is caused by the steps 33, and are thus formed in a stepped manner, as in the position 50 on the longer axis x.

Therefore, the influence of the steps 33 formed by the reinforcing beads 28 upon the appearance quality of the phosphor screen is highest at the end portions on the diagonal axis d, and smaller at end portions on the shorter axis y (which are close to the long sides 21*a*) and end portions on the longer axis x (which are close to the short sides 21*b*) than the end portions on the diagonal axis d. In addition, the incident angle of the electron beam 9 to the end portion on the longer axis x is smaller than that of the electron beam 9 to the end portion on the shorter axis y. Moreover, the end portion on the longer axis x is more greatly affected by the steps 33 than the end portion on the shorter axis y. In particular, this is more remarkable in a color cathode ray tube provided with a panel having an aspect ratio of 16:9.

However, even if the reinforcing beads 28 are formed on the shadow mask 20, when their heights are set to satisfy the above relationships (1) and (2) as in the above embodiment of the present invention, the influence of the steps 33 upon formation of the phosphor screen is reduced, and thus lowering of the appearance quality of the phosphor screen can be prevented.

Furthermore, due to the reinforcing beads 28, the above structure of the embodiment obtains the same strength as the thickness of a mask body 24 is increased. In addition, by the plastic deformation of the mask body 24 which occurs when the reinforcing beads 28 are formed, the curved surface-holding strength of the mask body 24 can be improved.

Figure 7:
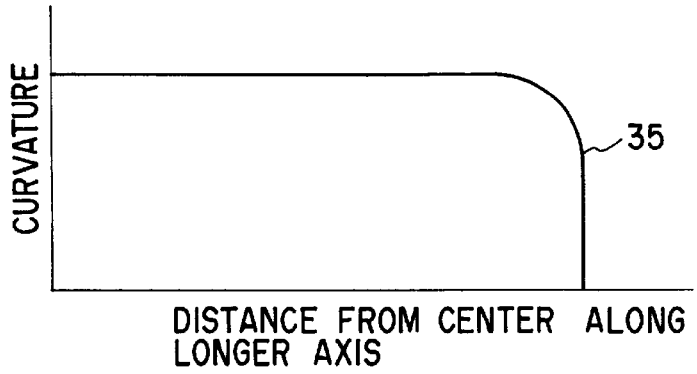
FIG. 7 is a graph showing a relationship between the curvature of a mask body and the position with respect to the center of the mask body (the distance between the position and the center)

Moreover, according to the embodiment, in the effective surface 21 of the mask body 24, the curvature of the vicinity of the peripheral portion is set to be greater than that of the vicinity (central portion) of the center O as shown by a curve 35 in FIG. 7 in which the axis of abscissa indicates the distance from the center along the longer axis x, and the axis of ordinate indicates the curvature. This is intended to increase the curved surface-holding strength of the peripheral portion. With the above construction, in the central portion of the effective surface 21, which cannot be formed to have a great curvature, the reinforcing beads 28 which have heights larger than those of the reinforcing beads arranged at the peripheral portion of the mask body are provided so as to obtain a sufficient curved surface-holding strength. On the other hand, in the peripheral portion of the effective surface, wherein the heights of the reinforcing beads are low, the curved surface-holding strength is increased by setting the curvature of the peripheral portion at a greater value than that of the central portion. By virtue of this structure, the curved surface-holding strength of the entire effective surface 21 can be uniformly improved.

In addition, local doming of the shadow mask can be restricted by increasing the curvature of that portion of the mask body 24 which is provided from a position a distance apart from the center O to the end portion on the longer axis, the distance being approximately ⅓ of the distance between the center O and the short side 21*b*.

In the above embodiment, the reinforcing beads 28 are provided on the entire effective surface 21. However, they may be provided only on a part of the effective surface 21.

Figure 8:
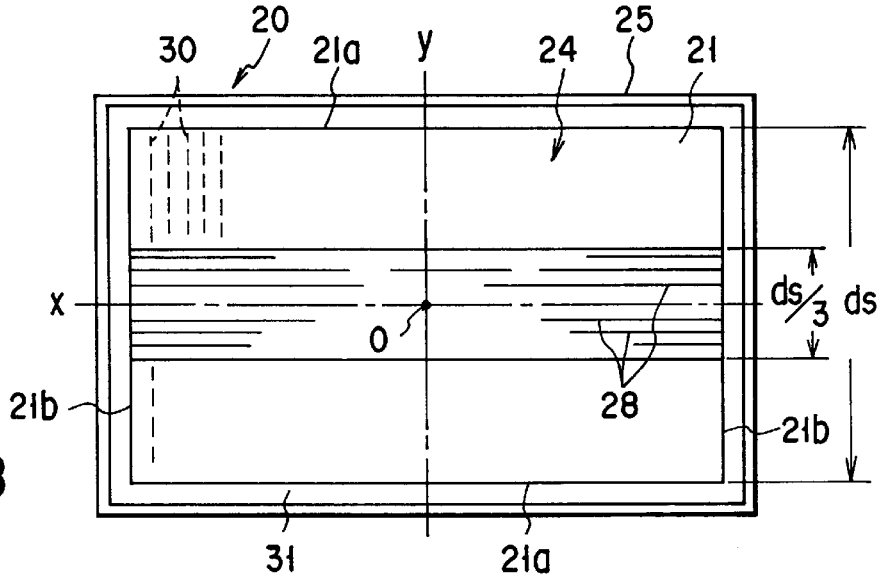
FIG. 8 is a front view of a shadow mask according to another embodiment of the present invention.

According to another embodiment of the present invention shown in FIG. 8, the mask body 24 of the shadow mask 20 has a plurality of strip-shaped reinforcing beads 28 extending in parallel with the longer axis x in a region which is provided symmetrically with respect to the longer axis x to have a width of ds/3, where ds is the width of the effective surface 21, i.e., it is a distance between the long sides 21*a*of the effective surface 21. The heights of the reinforcing beads 28 are set to satisfy the above mentioned relationships (1) and (2). In this embodiment, the other structural features are the same as those of the aforementioned embodiment, and thus their explanations will be omitted.

The shadow mask according to the other embodiment, as well as the above embodiment, has the following advantage: the reinforcing beads 28 can increase the curved surface-holding strength of the effective surface 21 without influencing on formation of the phosphor screen. Therefore, in the resultant color cathode ray tube, lowering of the image quality can be reduced, which is caused by deformation of the shadow mask in the manufacturing process and doming of the shadow mask at the operating time of the color cathode ray tube.

Figure 9:
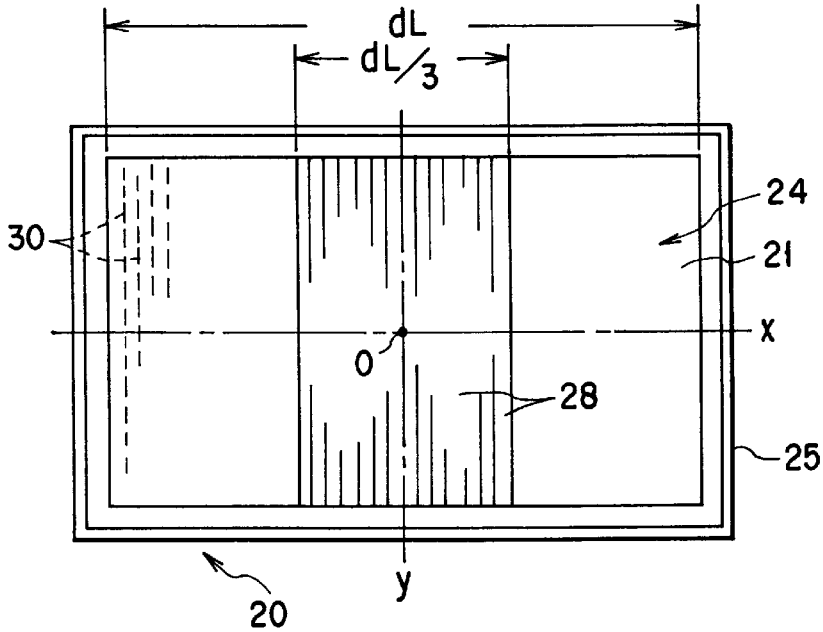
FIG. 9 is a front view of a shadow mask according to a further embodiment of the present invention.

Furthermore, according to a further embodiment of the present invention shown in FIG. 9, the effective surface 21 of the shadow mask 20 has a plurality of strip-shaped reinforcing beads 28 extending in parallel with the shorter axis y in a region which is provided symmetrically with respect to the shorter axis y to have a width of dL/3, where dL is a length of the effective surface 21, i.e., it is a distance between the short sides 21*b* of the effective surface 21. The heights of the reinforcing beads 28 are set to satisfy the above-mentioned relationships (1) and (2). In this embodiment also, the other structural features are the same as those of the aforementioned embodiment, and thus their explanations will be omitted.

Figure 10A:
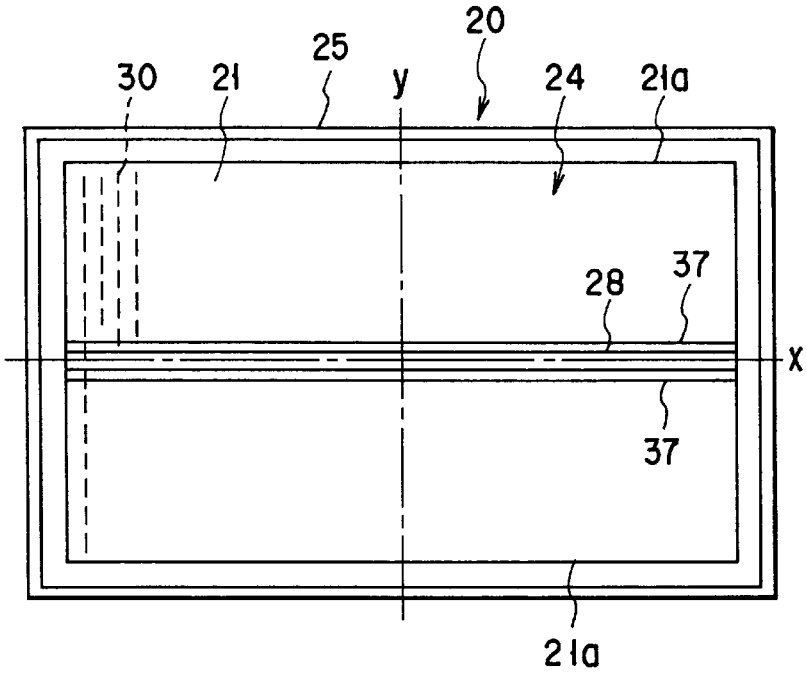
FIG. 10A is a front view of a shadow mask according to yet another embodiment of the present invention.
Figure 10B:
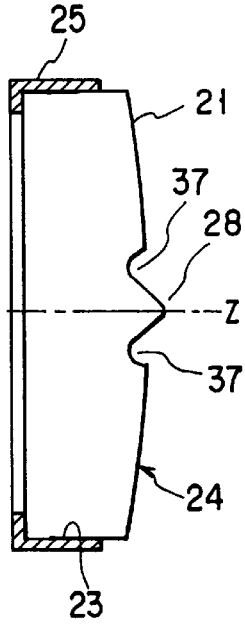
FIG. 10B is a cross-sectional view of the shadow mask shown in FIG. 10A.

Also, with this embodiment, the reinforcing beads 28 can increase the curved surface-holding strength of the effective surface 21 without influencing on formation of the phosphor screen. Therefore, in the resultant color cathode ray tube, lowering of the image quality is reduced, which is caused by deformation of the shadow mask in the manufacturing process and doming of the shadow mask at the operating time of the color cathode ray tube. In a shadow mask shown in FIGS. 10A and 10B, one strip-shaped reinforcing bead 28 is formed on the longer axis x of the effective surface 21 of the mask body 24, and curvature inversed portions 37 are provided in small regions on the both sides of the reinforcing bead 28. The curvature inversed portion 37 extend along the reinforcing bead 28 and project in the direction opposite to the phosphor screen. In the shadow mask 20 having this structure, the curved surface-holding strength of the effective surface 21 is lower than those of the effective surfaces 21 in the aforementioned embodiments, but the strength of the entire mask body 24 is improved as in those embodiments. Therefore, the color cathode ray tube having the shadow mask shown in FIGS. 10A and 10B also reduces lowering of the image quality, which is caused by deformation of the shadow mask in the manufacturing process and doming of the shadow mask at the operating time of the color cathode ray tube.

The present invention is not limited to the above-mentioned embodiments, and various modifications can be applied within the scope of the present invention. For example, the phosphor screen may be formed of dot-shaped phosphor layers.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube comprising:

an envelope including a panel and a funnel joined to the panel, the panel having a substantially rectangular effective portion and a phosphor screen formed on an inner surface of the effective portion;

a shadow mask arranged to oppose the phosphor screen; and an electron gun provided within a neck of the funnel, for emitting electron beams onto the phosphor screen through the shadow mask;

the shadow mask including:

a substantially rectangular effective surface having a large number of electron beam passage apertures formed therein, for allowing the electron beams to pass therethrough, the effective surface having a center located on a tube axis, and a longer axis and a shorter axis extending perpendicular to each other through the center; and a plurality of reinforcing beads formed on the effective surface to reinforce the effective surface, the reinforcing beads projecting the effective surface and having heights which vary in accordance with positions such that the heights of the reinforcing beads decrease successively or in stages by a predetermined distance away from the longer axis, and the heights of the reinforcing beads decreases successively or in stages by a predetermined distance away from the shorter axis.

2. A color cathode ray tube comprising:

an envelope including a panel and a funnel joined to the panel, the panel having a substantially rectangular effective portion and a phosphor screen formed on an inner surface of the effective portion;

a shadow mask arranged to oppose the phosphor screen; and an electron gun provided within a neck of the funnel, for emitting electron beams onto the phosphor screen through the shadow mask;

the shadow mask comprises:

a substantially rectangular effective surface having a large number of electron beam passage apertures formed therein, for allowing the electron beams to pass therethrough, the effective surface having a center located on a tube axis, and a longer axis and a shorter axis extending perpendicular to each other through the center; and a plurality of reinforcing beads formed on the effective surface to reinforce the effective surface, the reinforcing beads projecting from the effective surface and having heights which vary in accordance with positions such that in at least a part of that area of the effective surface on which the reinforcing beads are provided, the heights of the reinforcing beads satisfy the following relationship:

$$dx1>dx2,\ dy1>dy2$$

where dx1 denotes the height measured at a first position which is apart from the longer axis, and which is a distance x1 apart from the shorter axis, dx2 denotes the height measured at a second position which is further apart from the longer axis than the first position, and which is a distance x2 apart from the shorter axis, dy1 denotes the height measured at a third position which is located on the shorter axis, and which is a distance y1 apart from the longer axis, and dy2 denotes the height measured at a fourth position which is apart from the shorter axis, and which is a distance y2 apart from the longer axis, and the distances x1, x2, y1 and y2 satisfy the following relationship: x1=x2=y1=y2.

3. A color cathode ray tube according to claim 2, wherein the reinforcing beads have a strip-shape and extend substantially in parallel to the longer axis.

4. A color cathode ray tube according to claim 2, wherein the reinforcing beads has a strip-shape and extend substantially in parallel to the shorter axis.

5. A color cathode ray tube according to claim 2, wherein the reinforcing beads are formed to satisfy the following relationship: $dy1 \geqq dx1$.

6. A color cathode ray tube according to claim 2, wherein the effective surface is formed as a curved surface, and has a curvature which varies such that the curvature of a peripheral portion of the effective surface is greater than that of a central portion thereof.

7. A color cathode ray tube comprising:

an envelope including a panel and a funnel joined to the panel, the panel having a substantially rectangular effective portion and a phosphor screen formed on an inner surface of the effective surface;

a shadow mask arranged to oppose the phosphor screen; and an electron gun provided within a neck of the funnel, for emitting electron beams onto the phosphor screen through the shadow mask;

the shadow mask including: a substantially rectangular effective surface having a large number of electron beam passage apertures formed therein, for allowing the electron beams to pass there through, the effective surface having a center located on a tube axis, and a longer axis and a shorter axis extending perpendicular to each other through the center; and a plurality of reinforcing beads formed on the effective surface to project therefrom and reinforcing the effective surface, the reinforcing beads extending in parallel with the longer axis, and being provided in a region having a width of dL/3, where dL is a distance between long sides of the effective surface.

8. A color cathode ray tube according to claim 7, wherein the reinforcing beads have projecting heights which vary in accordance with positions such that the heights of the reinforcing beads decrease successively or in stages by a predetermined distance away from the longer axis, and the heights of the reinforcing beads decreases successively or in stages by a predetermined distance away from the shorter axis.

9. A color cathode ray tube according to claim 7, wherein the reinforcing beads have projecting heights which vary in accordance with positions such that in at least a part of that region of the effective surface on which the reinforcing beads are provided, the heights of the reinforcing beads satisfy the following relationship:

$$dx1>dx2,\ dy1>dy2$$

where dx1 denotes the height measured at a first position which is apart from the longer axis, and which is a distance x1 apart from the shorter axis, dx2 denotes the height measured at a second position which is further apart from the longer axis than the first position, and which is a distance x2 apart from the shorter axis, dy1 denotes the height measured at a third position which is located on the shorter axis, and which is a distance y1 apart from the longer axis, and dy2 denotes the height measured at a fourth position which is apart from the shorter axis, and which is a distance y2 apart from the longer axis, and the distances x1, x2, y1 and y2 satisfy the following relationship: x1=x2=y1=y2.

10. A color cathode ray tube according to claim 7, wherein the effective surface is formed as a curved surface, and a curvature of a peripheral portion of the effective surface is greater than that of a central portion thereof.

11. A color cathode ray tube comprising:

an envelope comprising a panel and a funnel joined to the panel, the panel having a substantially rectangular effective portion and a phosphor screen formed on an inner surface of the effective portion;

a shadow mask arranged to oppose the phosphor screen; and an electron gun provided within a neck of the funnel, for emitting electron beams onto the phosphor screen through the shadow mask;

the shadow mask including:

a substantially rectangular effective surface having a large number of electron beam passage apertures formed therein, for allowing the electron beams to pass therethrough, the effective surface having a center located on a tube axis, and a longer axis and a shorter axis extending perpendicular to each other through the center; and a plurality of reinforcing beads formed on the effective surface to project therefrom and reinforcing the effective surface, the reinforcing beads extending in parallel with the short axis, and being provided in a region having a width of dS/3, where dS is a distance between short sides of the effective surface.

12. A color cathode ray tube according to claim 11, wherein the reinforcing beads have projecting heights which vary in accordance with positions such that the heights of the reinforcing beads decrease successively or in stages by a predetermined distance away from the longer axis, and the heights of the reinforcing beads decreases successively or in stages by a predetermined distance away from the shorter axis.

13. A color cathode ray tube according to claim 11, wherein the reinforcing beads have projecting heights which vary in accordance with positions such that in at least a part of that region of the effective surface on which the reinforcing beads are provided, the heights of the reinforcing beads satisfy the following relationship:

$$dx1>dx2,\ dy1>dy2$$

where dx1 denotes the height measured at a first position which is apart from the longer axis, and which is a distance x1 apart from the shorter axis, dx2 denotes the height measured at a second position which is further apart from the longer axis than the first position, and which is a distance x2 apart from the shorter axis, dy1 denotes the height measured at a third position which is located on the shorter axis, and which is a distance y1 apart from the longer axis, and dy2 denotes the height measured at a fourth position which is apart from the shorter axis, and which is a distance y2 apart from the longer axis, and the distances x1, x2, y1 and y2 satisfy the following relationship: x1=x2=y1=y2.

14. A color cathode ray tube according to claim 11, wherein the effective surface is formed as a curved surface, and a curvature of a peripheral portion of the effective surface is greater than that of a central portion thereof.

* * * * *